United States Patent [19]

Hillard et al.

[11] Patent Number: 4,861,195

[45] Date of Patent: Aug. 29, 1989

[54] CABLE PLOW CHUTE

[75] Inventors: Randy H. Hillard; Robert G. Draney; Joseph J. Lesher, all of Wichita, Kans.

[73] Assignee: J. I. Case Company, Racine, Wis.

[21] Appl. No.: 231,405

[22] Filed: Aug. 12, 1988

[51] Int. Cl.[4] ..... E02F 5/02

[52] U.S. Cl. ..... 405/180; 37/193; 405/174

[58] Field of Search ..... 405/174–182; 172/734, 681, 101, 719; 111/7, 23; 47/56; 74/502.6; 37/193

[56] References Cited

U.S. PATENT DOCUMENTS

| | | | |
|---|---|---|---|
| 2,988,026 | 6/1961 | Heckathorn | 111/7 |
| 3,111,007 | 11/1963 | Ryan | 405/177 X |
| 3,429,134 | 2/1969 | Coffey | 405/181 X |
| 3,782,480 | 1/1974 | Schmahl | 405/182 X |
| 4,200,410 | 4/1980 | Baker et al. | 405/181 X |

FOREIGN PATENT DOCUMENTS

| | | | |
|---|---|---|---|
| 1119312 | 3/1956 | France | 405/181 |
| 2313619 | 12/1976 | France | 405/180 |
| 250242 | 7/1970 | U.S.S.R. | 405/180 |
| 1216813 | 3/1986 | U.S.S.R. | 405/180 |

*Primary Examiner*—Dennis L. Taylor
*Attorney, Agent, or Firm*—Dykema Gossett

[57] ABSTRACT

A cable guiding chute assembly suitable for attachment to a vibratory plow blade to dispense a cable at a selected drop radius. The cable chute assembly includes a pair of generally vertical side wall members joined by a forward wall to define a cable passageway and interchangeable gate members extending the length of the passageway to define cable guiding conduits having different radii. Each gate member is releasably secured to the side walls of the chute to permit expeditious removal and replacement. Further, the chute assembly is constructed with minimal surface area to reduce drag and a leading edge to reduce the build-up of material between the chute and plow blade. Moreoever, the chute assembly includes a downwardly directed bottom opening which permits pulling of the cable when the plow blade is removed from the ground without damaging the cable exterior. The simplified construction for dispensing a single cable also permits the removal and substitution of one gate for another when the plow blade and chute assembly are still in the ground.

5 Claims, 2 Drawing Sheets

Fig-1
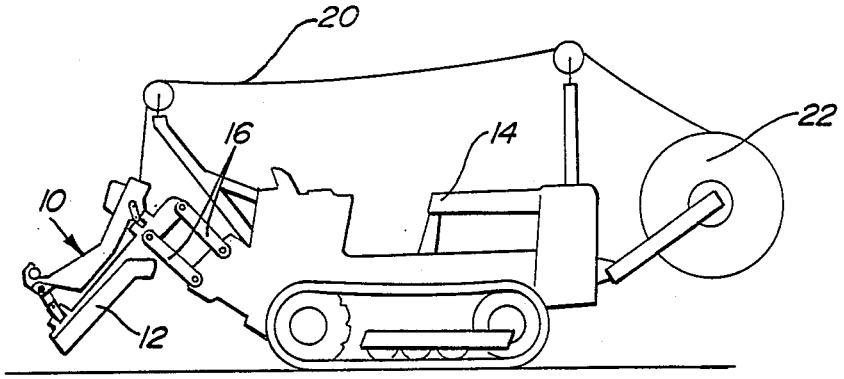
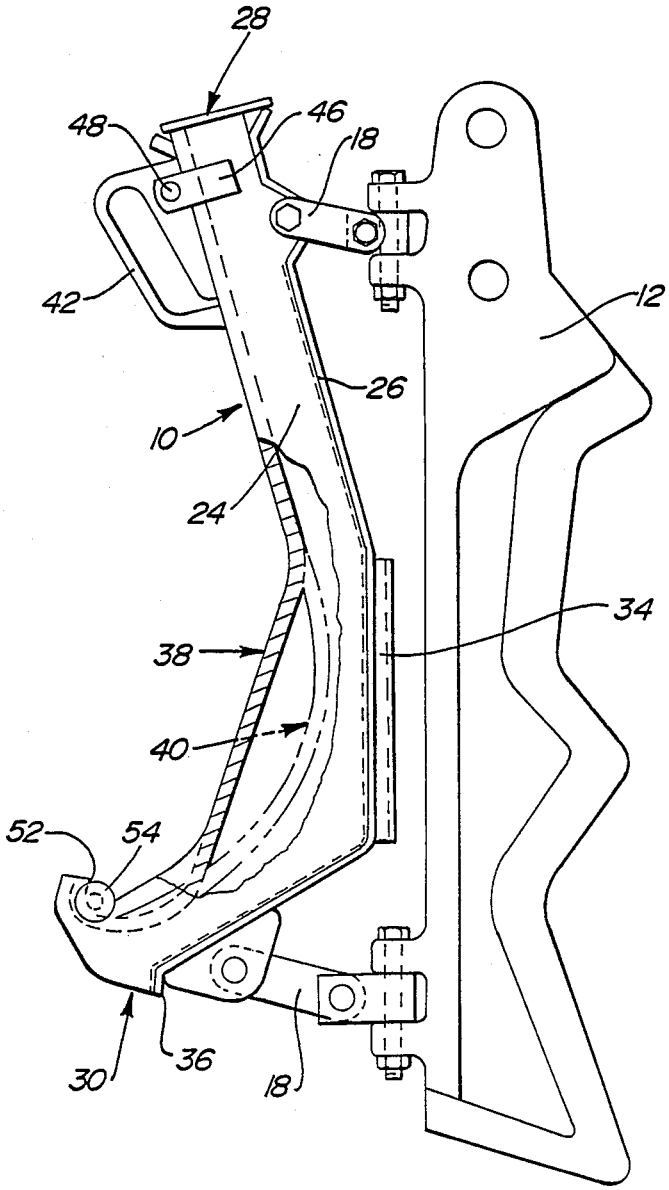
Fig-2

CABLE PLOW CHUTE

BACKGROUND OF THE INVENTION

The present invention relates to a cable guiding chute for vibratory cable laying plows. More specifically, the present invention relates to a cable chute having a plurality of gates that are selectively used depending upon the desired cable radius that is needed for the specific job.

Various cable guiding chutes have been proposed in the prior art. Examples of prior art patents which broadly teach the idea of guiding and laying cables include U.S. Pat. Nos. 3,222,876, 3,338,060 and 3,395,545. These patents, however, do not teach the use of any structure which improves the accessability to the cable guiding chute or the dispensing and guiding of cable at different radii. Similarly, several other prior art patents include a general teaching of a removable component to provide accessability to the interior of the cable guiding chute, examples of such prior art being U.S. Pat. Nos. 3,926,004, 3,931,717 and 3,948,059, which are assigned to the assignee of the present invention. These patents also do not suggest an improved structure for providing ease in accessibility, dispensing and guiding cables for vibratory plows.

A base shortcoming in conventional cable chutes of the type disclosed in the aforementioned patents is the inability to quickly and conveniently change from one cable radius to another. Further, the large surface area of the sides of typical cable chutes creates a drag during the dispensing and guiding of the cable. Moreover, the potential for damage to the cable exists in conventional chute constructions when the plow blade is removed from the ground. Thus, there has been a need for a cable chute construction which overcomes the shortcomings of the prior art.

It is, therefore, an object of the present invention to provide a cable chute that is capable of guiding and laying cables at different drop radii. It is a further object of the present invention to provide a construction which improves the accessibility to the interior of the cable chute and improves the dispensing and guiding of the cable. Moreover, the present invention is intended to provide an uncomplicated cable guiding structure for permitting easy removal, insertion, or replacement of cables as the need arises.

SUMMARY OF THE INVENTION

The present invention relates to a cable guiding and dispensing chute suitable for use with a ground slitting blade for placing a cable or the like within the ground.

The chute is a generally J-shaped box-like structure having an opening at an upper end thereof to receive a cable and a lower bottom opening for the cable exit. The open bottom of the chute allows the cable to be pulled out of the chute without damaging the cable when the vibratory plow is lifted out of the ground. Further, the reduced surface area of the sides of the chute provide a reduction in drag as compared to prior constructions. Moreover, the leading edge of the chute includes an edge which reduces the build-up of dirt and the like between the chute and the vibratory plow blade.

The chute of the present invention further includes removable gates which are generally J-shaped to fit in a complementary fashion between the sides of the chute. Each gate is constructed to create a different radius in the cable between the upper and lower ends of the chute. The gates are selectively secured to the chute and are releasable such that expeditious changes in the cable drop radii may be made. Each gate is generally aligned with the rearwardmost edges of the side walls of the chute when the gate is in its nested position within the chute thereby completely closing the chute except for the upper cable entry opening and the bottom exit opening. Further, the gate is releasably maintained at its nested position for cable laying operation by a locking assembly including a handle having a locking pin. Thus, the radius of the cable within the chute may be conveniently changed by simply removing one gate and installing another.

When it is desired to insert, remove or replace a cable within the chute, the locking assembly for the gate is released and the gate is withdrawn from its nested position within the chute. Once withdrawn, the side walls and front wall of the chute define an open channel which exposes the previously positioned cable for expeditious removal if desired. If it is desired to change the drop radius of the cable within the chute, another gate is positioned within the chute and locked into place between the chute side walls. Therefore, the advantages provided by the present invention include the ability to easily insert or remove a cable, the ability to change the drop radius of the cable within the chute, the ability to remove the cable from the chute when the blade is still in the ground, and the ability to reduce drag and debris build-up between the chute and the blade.

Other advantages and meritorious features of the present invention will be more fully understood from the following description of the invention, the appended claims, and the drawings, a brief description of which follows.

BRIEF DESCRIPTION OF DRAWINGS

FIG. 1 is a side elevational view of the cable chute assembly of the present invention in the environment of a crawler tractor and vibratory plow blade.

FIG. 2 is a side elevational view of the cable dispensing chute and vibratory plow blade.

DETAILED DESCRIPTION OF THE INVENTION

Figure 3:
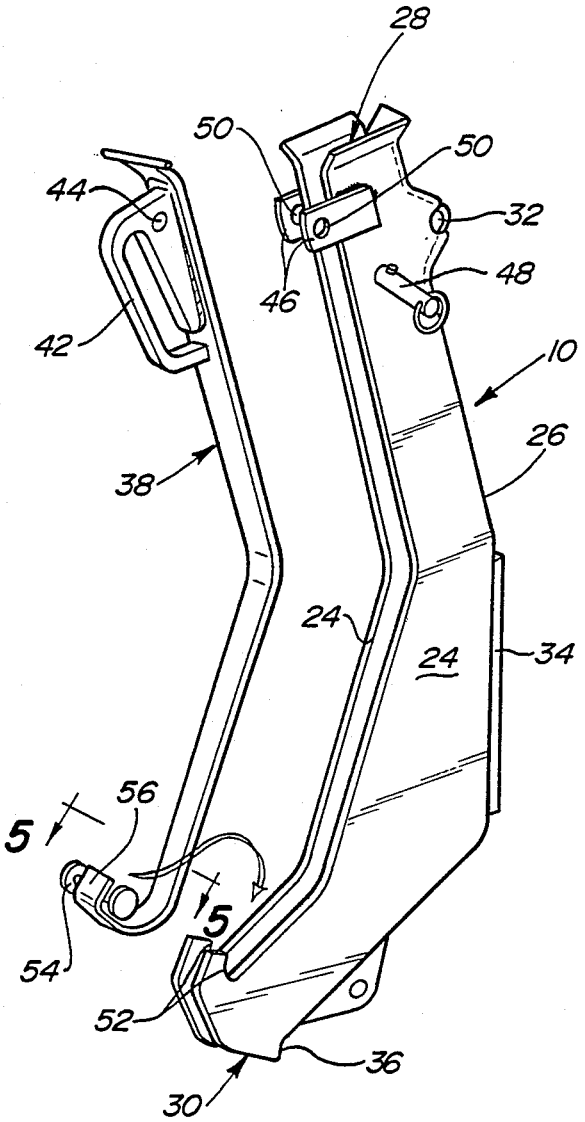
FIG. 3 is a perspective assembly view illustrating the cable chute and one of the gates that is selectively usable with the chute.
Figure 4:
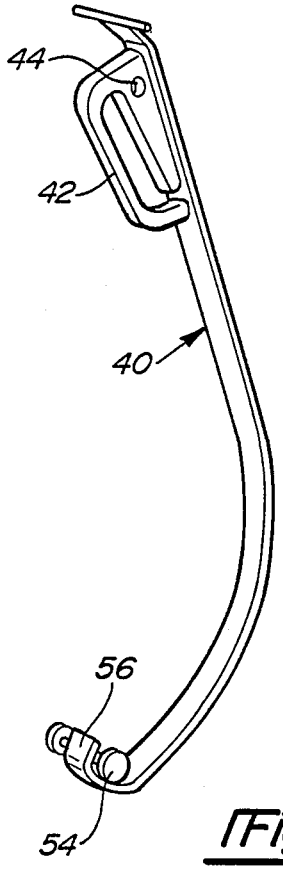
FIG. 4 is a perspective view of another gate that is usable with the cable chute.
Figure 5:
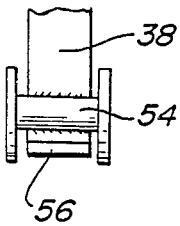
FIG. 5 is a cross-sectional view taken along line 5—5 in FIG. 3.

The present invention relates specifically to an improved cable guiding and dispensing chute 10 which is designed to be used in combination with a vibratory plow blade 12, as illustrated in FIGS. 1–2. The vibratory plow blade and cable dispensing assembly is attached in a conventional fashion to a crawler tractor 14 by means of support limbs 16.

As is conventional, the vibratory plow blade 12 is vertically vibrated for cutting a slot in the ground. The cable dispensing chute 10 is connected to blade 12 by links 18 that are pivoted freely at their respective opposite ends to the blade and to the chute to eliminate the transmission of vibratory motion from the blade to the chute. The cable 20 which is fed into the cable dispensing and guiding chute 10 may be disposed from a cable drum 22 which is supported by conventional support structure on the craawler tractor 14.

Referring now to FIGS. 2–5, it can be seen that the cable dispensing chute 10 includes a pair of generally J-shaped side walls 24 which are connected by a forward wall 26 to define a generally open box-like structure. It can be seen from FIG. 3 that the side walls 24 and front wall 26 define an opening 28 at their upper ends through which the cable 20 may enter. After entering the chute 10, cable 20 then passes generally downwardly through the space between the side walls 24 and exits at the lower bottom opening 30 between the side walls for horizontal placement within the ground.

The front wall 26 and side walls 24 define an opening 32 (FIG. 3) for the purpose of permitting a pivotal attachment between link 18 and chute 10 adjacent its upper end. Further, front wall 26 includes an edge surface 34 which minimizes the build-up of packed dirt and debris between chute 10 and plow blade 12. Moreover, front wall 26 includes a generally vertically disposed lip portion 36 for the purpose of defining the lower bottom opening 30 which allows cable 20 to be pulled out of the chute 10 without damaging the cable when plow blade 12 is removed from the ground. This construction eliminates the prior rearwardly directed opening for the cable exit which has the potential for damaging the cable when the plow blade is out of the ground and the cable is pulled from the lower end of the chute. As is more fully discussed below, the forward wall 26 cooperates with a selected gate component to define a cable guiding conduit extending from upper chute opening 28 to the bottom chute opening 30.

As illustrated in FIGS. 2–5, the chute assembly 10 may be provided with different gates to selectively change the drop radius of cable 20. FIG. 3 and the cross-sectioned portion of FIG. 2 illustrate a first gate 38 while FIG. 4 and the phantom lines in FIG. 2 illustrate a second gate 40. Gates 38 and 40 each include a handle portion 42 having an opening 44 therein. Handle 42 is placed between the opposed plates 46 on side walls 24 and a locking pin 48 is inserted through the openings 50 in plates 46 and opening 44 in handle 42 for releasably securing handle 42 to chute 10.

Chute 10 includes a pair of opposed slots 52 at its lower end to which a pin 54 is rigidly connected. Each gate 38 and 40 includes a bent end portion 56 which is loosely attached to pin 54 when the selected gate is nested between side walls 24, as shown in FIG. 2. Thus, gate 38 may be replaced with gate 40 or vice versa in a convenient fashion by removing the locking pin 48 from handle 42 and moving the bent end portion 56 away from pin 54.

The present construction is intended to provide a convenient and expeditious changeover from one radius to another for a single cable. The side walls 24 are relatively narrow as compared to prior constructions such that there is less surface area in the side walls thereby providing an overall drag reduction. Further, as previously described, the leading edge 34 of the chute assists in the reduction of build-up between the chute 10 and plow blade 12. Moreover, the bottom opening 30 permits cable 20 to be pulled out of chute 10 when plow blade 12 is removed from the ground without damaging the cable. Since gates 38 and 40 are relatively narrow and do not include interfering flanges and the like, each gate may be removed from chute 10 while the plow blade 12 and chute 10 are still in the ground by simply removing locking pin 48 and lifting the gate vertically. Thus, the chute assembly 10 of the present invention provides simplicity for the expeditious changing from one drop radius to another and an improved construction for maneuvering the cable.

It will be apparent to those skilled in the art that the foregoing disclosure is exemplary in nature with the invention being further defined by the appended claims.

What is claimed is:

1. In a cable laying apparatus comprising a ground slitting blade attached to a prime mover and a cable laying chute assembly connected to a trailing portion of said blade, said chute assembly including:

a pair of spaced generally parallel J-shaped side wall plates defining a portion of said chute assembly, the space between upper end portions of said side walls defining an entrance region for a cable and a space between lower end portions of said side walls defining an exit region for said cable;

a plurality of selectively usable gate members, each said gate member releasably maintained in position between said side walls during a cable laying operation, each gate member cooperating with said side walls to define a cable guiding channel extending from said entrance region to said exit region, each gate member having a generally arcuate portion for guiding and supporting a cable at a specific drop radius as the cable is fed through the chute assembly into a horizontal position within a slot cut in the ground by said blade, and the generally arcuate portion for each gate member being configured differently from the generally arcuate portion of another gate member whereby said gate members are selectively used within said chute assmbly depending upon the desired cable radius drop that is required for a specific task; and means releasably maintaining a selected gate member in position between said side walls such that the selected gate member may be withdrawn from the chute assembly to enable expeditious insertion or removal of said cable within said chute assembly for all locations of said blade.

2. The cable laying apparatus as defined in claim 1 wherein said generally parallel J-shaped side walls are connectec by a forward wall to define a generally open box-like structure, and said front wall including an edge surface between said chute assembly and said blade which minimizes the build-up of debris between said chute assembly and said blade.

3. The cable laying apparatus as defined in claim 2 wherein said front wall includes a lip portion adjacent said exit region, said lip portion and side walls defining a bottom opening which allows said cable to be easily pulled from said chute assembly when said blade is removed from the ground thereby minimizing the potential for damage to the cable.

4. The cable laying apparatus as defined in claim 1 wherein said generally J-shaped side walls include opposed slots at their lower ends for mounting a pin, each gate member includes a bent portion adjacent one of its ends which is loosely connected to said pin when a selected gate member is nested between said side walls, and each said gate member including a handle adjacent its opposite end which is connected by releasable locking means to said side walls.

5. The cable laying apparatus as defined in claim 1 wherein said J-shaped side walls are narrow to minimize the surface area therein and the generally arcuate portion of each gate member comprising a single element which cooperates with said side walls to define a channel for a single cable and wherein each element engages said cable to direct the cable along a specific path through the chute assembly, and wherein the path of movement of said cable through said chute assembly is selectively changed when one gate member is interchanged for another.

* * * * *